United States Patent [19]

Nam

[11] Patent Number: 4,531,480

[45] Date of Patent: Jul. 30, 1985

[54] POWER MAGNIFICATION APPARATUS OF A INTERNAL AND EXTERNAL ENGINE

[76] Inventor: Chul W. Nam, K.P.O. Box 341, Seoul, Rep. of Korea

[21] Appl. No.: 438,647

[22] Filed: Nov. 3, 1982

[30] Foreign Application Priority Data

| | | | |
|---|---|---|---|
| Nov. 5, 1981 | [KR] | Rep. of Korea | 4241/1981 |
| Nov. 14, 1981 | [KR] | Rep. of Korea | 4395/1981 |
| Dec. 9, 1981 | [KR] | Rep. of Korea | 4863/1981 |

[51] Int. Cl.[3] ..... F02B 75/00

[52] U.S. Cl. ..... 123/19

[58] Field of Search ..... 123/193 R, 193 P, 19

[56] References Cited

U.S. PATENT DOCUMENTS

| | | | |
|---|---|---|---|
| 2,734,494 | 2/1956 | Waterval | 123/52 B |
| 4,205,638 | 6/1980 | Vlacancinch | 123/19 |
| 4,319,546 | 3/1982 | Beden | 123/19 |
| 4,489,681 | 12/1984 | Jackson | 123/52 B |

FOREIGN PATENT DOCUMENTS

| | | | |
|---|---|---|---|
| 0172629 | 7/1906 | Fed. Rep. of Germany | 123/19 |
| 901605 | 1/1954 | Fed. Rep. of Germany | 123/52 B |
| 0366046 | 9/1906 | France | 123/19 |
| 0556675 | 2/1957 | Italy | 123/19 |

*Primary Examiner*—Craig R. Feinberg

*Attorney, Agent, or Firm*—Armstrong, Nikaido, Marmelstein & Kubovcik

[57] ABSTRACT

A piston power transmission apparatus is disclosed having an upper cylinder block, a lower cylinder block, a vertical wall mounted in the upper cylinder block to provide an internal chamber and external chamber respectively, the top piston being slidably housed in the internal chamber and a ring-type piston being slidably fitted in the external chamber, and a bottom piston being slidably mounted in the lower cylinder block with a diameter larger than that of the top piston, a compressed air tank which is communicated through a guide pipe with an external chamber causing the ring-type piston to move downward as soon as the pressure in the internal and external chambers falls below the air tank pressure, wherein the bottom piston and the top piston are connected to each other by the piston rod guide, and the space enclosed by the top piston, the ring-type piston and the bottom piston is filled with an incompressible fluid oil.

2 Claims, 7 Drawing Figures

POWER MAGNIFICATION APPARATUS OF A INTERNAL AND EXTERNAL ENGINE

This invention relates to piston power transmission apparatus for an internal combustion engine which increases crank-shaft torque.

Conventional internal combustion engines are comprised of 4 stroke or 2 stroke cylinders provided with only single pistons respectively, which are propelled by expanding gas in a fixed cylinder volume during the power stroke. The piston is attached to one end of a connecting rod, the other end of which is connected to a crank pin on the crank shaft. It is well known that with cylinders the efficiency of the thermal system is dependent upon the relationship between the heat energy in the fuel and the engine power output which is related to the given cross-sectional area or piston stroke distance of the piston, the heat energy of the fuel and the work output. If the initial temperature, the compression ratio, the cross-sectional area of the piston and the amount of the fuel-air mixture have a predetermined value, the net thermal efficiency of a conventional engine is within the range 25 to 29%.

This invention is designed to solve the above problem that limits the net thermal efficiency of conventional engines under the predetermined condition. Substantially this invention is comprised of an upper cylinder block, a lower cylinder block, a vertical wall mounted in the upper cylinder block to provide an internal chamber and external chamber respectively, the top piston being slidably housed in the internal chamber with the diameter equal to that of the conventional cylinder, the piston rod being bolted to the top piston at one end and inserted into the tubular piston rod guide at the other end, the annular ring type piston being a close sliding fit in the external chamber communicated through a guide pipe with an outer compressed air tank for supplying the compressed air, the bottom piston being slidably mounted in the lower cylinder block with the diameter larger than that of top piston being connected to the connection rod by the piston pin. Therefore in the operation of this invention, the pressure in the volume of the upper cylinder, which is equal to that of the conventional cylinder produced by the gas explosion during the power stroke, is transmitted through the fluid oil to the bottom piston so that it is multiplied by the cross-sectional area ratio between the top piston and the bottom piston as described in detail hereafter. The force produced by the gas explosion alone is constant depending on the variables such as predeterminated the amount of the fuel-air mixture, the initial temperature, etc.

The stroke distance of the top and bottom piston is shorter than that of the conventional piston, the bottom piston cannot reach the BDC point.

As to this, the annular ring type piston constructed according to this invention operats to push the bottom piston downward to the BDC point as soon as the pressure in the chamber drops below the pressure of the external compressed air tank. Consequently the piston power transmission apparatus comprising the two cylinder block transmits to the crank shaft an increased force in proportion to the cross-sectional area of the top and bottom piston.

Thus, it is the object of this invention to provide a piston power transmission apparatus for increasing thermal power efficiency thereby enhancing engine power output by it's utilization with an internal combustion engine.

In this invention there is provided a piston power transmission apparatus for an internal combustion engine, comprising a upper cylinder block and a lower cylinder block connected together at flange means thereof, a cylindrical vertical wall extending within and from the upper end of the top cylinder to divide the upper cylinder into an internal and external chamber, the top piston being housed in the internal chamber to move up and downward therein, the annular ring type piston being mounted in the external chamber communicated through a guide pipe with the outer compressed air tank causing the bottom piston to move down as soon as the pressure in the internal and external chamber falls below a predetermined value of the outer compressed air tank pressure, the bottom piston being slidably mounted in the lower cylinder-block with a larger cross-sectional area than that of the top piston, the piston rod being arranged between the top piston and the piston rod guide in such a manner that its upper end is fixed to the top piston and its lower end is inserted into the piston rod guide, the piston rod guide being connected to the bottom piston by engaging the threaded portion of its lower end with the threaded portion of the bottom piston projector, and the connection rod being connected to the bottom piston by the piston pin inserted into the base of said bottom piston.

An embodiment of the invention will now be described, by way of example, with reference to the accompanying drawings in which:

FIG. 2(*b*) is a diagram showing the relationship of combustion pressure and crank angle in the conventional engine.

Figure 1:
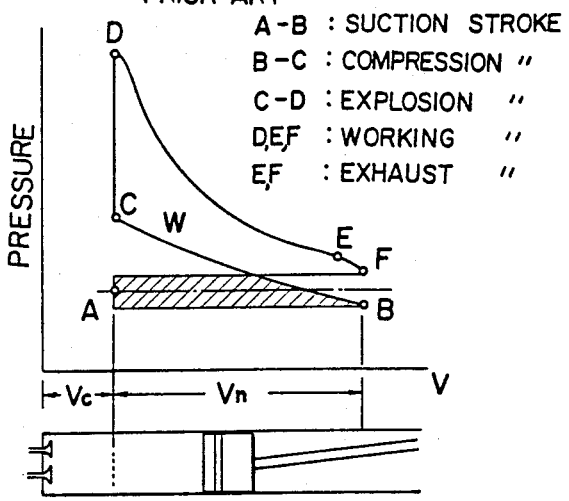
FIG. 1 PRIOR ART
FIG. 1 is a P-V indicater diagram of a conventional 4-stroke engine.

As an example, the combustion process of a conventional diesel engine is illustrated in FIG. 1 which is the indicator diagram of a 4 stroke engine. (A gasoline engine shows a similar rapid drop of pressures).

As shown in FIG. 1, the fuel injected in the combustion chamber at the end of a compression stroke (TDC) is combusted according to the following 4 steps: Namely, First period, Ignition lag period, combustion Preparation period (A-B period)

Second period, Flame propagation period, constant volume combustion period (B-C) period Third period, Direct combustion period, Constant pressure combustion period (C-D period)

Fourth period, Later combustion period, Late combustion period (D-E period)

Figure 2A:
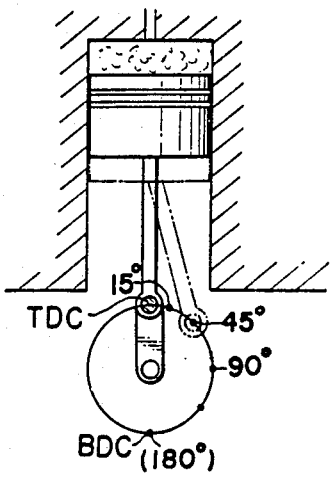
FIG. 2a PRIOR ART
FIG. 2(*a*) shows the driving angle of a crank of a conventional engine.
Figure 2B:
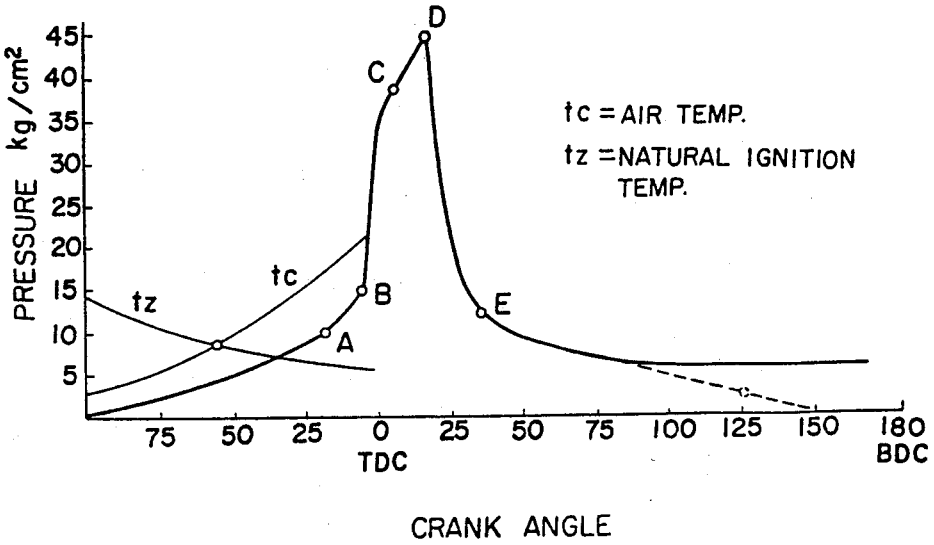
FIG. 2b PRIOR ART

When the fuel is combusted in 4 steps as above, the pressure and combustion relative to the crank angle are proved by practical experiment as shown FIG. 2. The detailed explanation is as follows:

Experimental data: With 2,000 rpm diesel engine (a) First period, Ignition lag period (Combustion preparation period)

This period is from the injection of fuel into the combustion chamber to the incidence of combustion. Crank angle is the range of 12°: (from 12° before TDC to TDC). In this period, particles of fuel absorb heat mainly from compressed air (partly from the cylinder and piston) and produce peroxide reaction so that ignition temperature is reached in short intervals of 1/1,000 to 4/1,000 seconds and there is substantially no rise in temperature and pressure in this period.

(b) Second period, Flame propagation period (Constant volume combustion period):

This period is from fuel ignition to explosive combustion. The fuel is ignited at point B after passing through the ignition lag period (A-B). At this time, most of a fuel injected in period A-B combusts simultaneously so that the temperature and pressure in the cylinder rise rapidly from point B to point C. This condition depends on air vortex, fuel property and mixture condition. Under appropriate conditions, flame propagation and the rise in pressure are faster.

(c) Third period, Direct combustion period (Constant pressure combustion period):

This period is the period in which injected fuel is almost combusted simultaneously with injection. The fuel is continuously injected after passing through point C. Accordingly, the injection fuel after point C is combusted almost simultaneously with injection because of the flame produced during the period B-C. Accordingly, variation in pressure during the period C-D can be controlled in some degree with control of injection fuel amount. This period is the controlled combustion period.

(d) Fourth period, Later combustion period (Late combustion period):

This period is a combustion and expansion period of the fuel not burned during the power stroks. This combustion period terminates at point D and combustion gas expands thereafter. However, the fuel not completely burned during power stroke is combusted in the expansion period D-E. Particularly, in a diesel engine, the increased pressure between flame propagation period should be reduced for the effective utilization of the direct combustion period (constant volume combustion period).

FIG. 2 shows the operation condition of a conventional engine and Table 1 shows the experimental data of crank angle TDC-180° BDC and explosive pressure variation of piston at 0° (TDC)

TABLE 1

| crank angle (°) | | combustion pressure (Kg/Cm$^2$) | |
|---|---|---|---|
| TDC | 5 | 75 | |
| TDC | 15 | 86 | D point (peak pressure point) |
| TDC | 20 | 80 | |
| TDC | 45 | 20 | |
| TDC | 50 | 14 | |
| TDC | 75 | 12 | |
| TDC | 90 | 11 | |
| TDC | 100 | 8 | |
| TDC | 125 | 5 | |
| TDC | 135 | 2 | |
| TDC | 140 | 0 | |
| TDC | 180 | BDC | |

As shown in the above Table 1, fuel is injected and gas explodes rapidly so that the pressure reaches its highest point (86 Kg/Cm$^2$) at TDC 15°. At TDC 45° point (at $\frac{1}{4}$ position of the upper piston $\frac{1}{8}$ position of the lower piston) the gas pressure drops rapidly and reaches TDC 90° at a pressure of 11 Kg/Cm$^2$. Thereafter the initial explosion pressure drops rapidly and at BDC, which is reached by the moment of inertia, gas expansion drops rapidly and almost reaches atmospheric pressure. Therefore, a conventional internal combustion engine was designed so that the explosion pressure in the combustion chamber produced by the gas explosion produces only force on the cross-sectional area of the piston under predetermined condition of initial temperature, compression ratio, etc. Thus the present invention is concerned with the problem of the pressure produced by gas expansion. In other words, the present invention is designed to increase the force acting on the cross-sectional area of the piston, thereby enhancing the power output of the thermal engine system by applying basic principles of fluid mechanics, in which it is based upon a difference of cross-sectional area between the top and bottom piston.

According to the principle of the present invention, the oil used for producing pressure is filled in the hollow chamber of cylinder functioning as an oil pump during the power stroke. Therefore the constant pressure produced by gas explosion under the predetermined condition is applied to the top piston.

Then the force exerted on the cross-sectional area of the top piston is transfered to oil pressure and then converted to mechanical energy which then pushes the bottom piston downward. Thus the force exerted on the cross-sectional area of the bottom piston is multiplied in proportion to the cross-sectional area between the top and bottom piston. It is noted that the stroke distance of the bottom piston is not sufficient to reach BDC.

Accordingly, the present invention provides a ring type piston in the external chamber of the upper cylinder block. The annular ring type piston is operated to compensate for the insufficient stroke distance as soon as the pressure in the cylinder chamber drops below the pressure of the outer compressed air tank.

Consequently the increasing force applied to the bottom piston is transfered to the crank shaft, therefore generating great energy to the crank shaft which is connected to the connecting.

In order to gain this greater energy, a piston power transmission apparatus embodying the present invention is characterized as follows. In the case of the cross-sectional areas of the top and bottom piston increasing the power output by 50%, the oil within cylinder chamber 8 fills $\frac{2}{3}$ of the bottom cylinder.

An example is given below:

top piston { diameter: 9 Cm
stroke: 9 Cm bottom piston { diameter: 11 Cm
stroke: 9 Cm -continued top piston sectional area ($Cm^2$): $A = \frac{\pi D^2}{4} = \frac{3.14 \times 9^2}{4} = 63.58 \simeq 64\ (Cm^2)$ volume ($Cm^2$): $V = \frac{\pi D^2}{4} \times h = \frac{3.14 \times 9^2}{4} \times 9 = 576\ (Cm^3)$ bottom piston sectional area: $A = \frac{\pi D^2}{4} = \frac{3.14 \times 11^2}{4} = 94.9 \simeq 95\ (Cm^2)$ volume: $V = \frac{\pi D^2}{4} \times h = \frac{3.14 \times 11^2}{4} \times 9 = 855\ (Cm^3)$ This mean effective pressure of engine is about 8 $Kg/Cm^2$. Therefore, (a) Force which is given to top piston:

$$F = P \times A$$

$$F = 8\ Kg/Cm^2 \times 64\ Cm^2 = 512\ Kg$$

Where,

F=Force (Kg)

P=Pressure ($Kg/Cm^2$)

A=Sectional Area ($Cm^2$)

(b) Force which is given to bottom piston:

$$F = P \times A$$

$$F = 8\ Kg/Cm^2 \times 95\ Cm^2 = 760\ Kg$$

(c) Relating (a) and (b):

$$(a) \div (b) = 760\ Kg \div 512\ Kg = 1.484 \simeq 1.5$$

$$1.5 \times 100 = 150(\%)$$

Therefore, this engine increases power by about 50%.

AT maximum explosion pressure (TDC 15°)

Gas pressure energy which is given to top piston:

$$F = P \times A = 86\ Kg/Cm^2 \times 64\ Cm^2 = 5{,}504\ Kg$$

Gas pressure energy which is given to bottom piston:

$$F = P \times A = 86\ Kg/Cm^2 \times 95\ Cm^2 = 8{,}170\ Kg$$

In the above example, by means of oil pressure energy, applied to the bottom piston the overall engine power output increases by about 50% and the volume of oil in the top piston cylinder can fill up to $\frac{2}{3}$ of the volume of the bottom cylinder can be filled with oil.

As shown above, in this invention, cylinder length can be twice as long as in a conventional engine by dividing a cylinder into two pieces at its middle and providing flanges for re-connecting the two cylinder portions making internal assembly easy. A cylindrical vertical wall may be provided in the upper cylinder block separating the internal chamber from the external chamber. In the lower cylinder block a bottom piston bigger than the top piston in volume is provided. The top piston may be connected with a piston rod. The annular ring type piston is mounted in the oil storge chamber and communicated through the guide pipe to the outer compressed air tank and the bottom piston is coupled with a connecting rod.

The different methods in which the bottom cylinder is pushed down by the use of stored oil in the chamber of upper cylinder block are as follows;

The first method relates to a ring type piston in an external chamber of the upper cylinder block, in which the annular ring type piston is pushed by compressed air from the air tank.

The second method relates to pouring a high pressure oil into the inner chamber by the use of outer compressed air and a booster for oil pressure.

The third method is different from the first two methods described above, because compressed air or an oil for producing oil pressure is not introduced in the cylinder, but rather the cylinder is made longer by about $\frac{1}{3}$ than in the above two methods. Therefore, the oil chamber is made wider.

The fourth method relates to solving the problem of insufficient oil in the internal and external chamber. The bottom piston consists of two pistons with a coil spring between them. The volume of limited oil in the cylinder chamber varies with the gap between the two bottom pistons. The engine comprises the upper cylinder head, the upper cylinder block and the lower cylinder block. The upper cylinder head is provided with guide pipe 18 which passes through said head and into external chamber 9 as explained later, with exhaust passage 31 and intake passage 32, and with ignition apparatus (not shown), wherein guide pipe 18 is commnnicated with the compressed air tank 27.

A upper cylinder block 1 and a lower cylinder block 2 are each provided with a flange 3 and one connected together by bolts 4 extending through the flanges 3. A cylindrical vertical wall 6 extending from a upper portion 5 is provided in the upper cylinder block 1. The inside of the vertical wall 6 defines an internal chamber 8 referred to as the combustion chamber in which is provided a top piston 7 for moving up and downward. Outside the vertical wall 6 is an external chamber 9 in the form of a cylinder for oil in which is provided an annular ring type piston. The end 7' of the vertical wall 6 tapers to branch off the flow of oil when the oil is pushed up. In the wall 6 and at the region where the cylinder blocks 1 and 2 are connected there are provided grooves 10 and 10' in which inner and outer edge portions of a support ring 11 are located in order to prevent vibration of the vertical wall 6. In order that oil can pass through the support ring 11, openings 11' are provided in the ring 11. The top piston 7 comprises two portions which together define a cavity (a) by engaging their inner and outer threaded portions, after a screw bolt and nut (b) fix the upper end of a piston rod 12 to the top piston, in which the bolt and nut are accessible when the two piston portions are separated. At the lower end of piston rod 12 is a piston rod head 12' which is larger than the outer diameter of the piston rod 12. A spring 13 surrounds the lower end or the piston rod 12 and contacts the head 12' at (c). The piston rod is arranged between the top piston 7 and the piston rod guide 14 in such a manner that its upper end is fixed the top piston 7 and its lower end is inserted into the piston rod guide 14, the piston rod guide 14 being connected to the bottom piston 15 by engaging the threaded portion of its lower end with the threaded portion of the bottom piston projector 34.

A tubular piston rod guide 14 surrounds the lower end of the piston rod 12, the head 12' and the spring 13 of the upper end and is fixed at its lower end having a threaded portion to a bottom piston 15 with a screw bolt 35, wherein the bottom piston 15 has the hollow projector 34 at its center to receive the piston rod guide 14 and has hole 30 at its base in which piston pin 30' is inserted for connecting connecting rod 16 to the said bottom piston 15. Also bottom piston 15 is slidably mounted in lower cylinder block with a larger cross-sectional area than the top piston.

The piston rod 12 has a free sliding motion in the piston rod guide 14. On starting the engine the bottom piston 15 is pulled down by a connecting rod 16 and the piston rod guide 14 acts on the piston rod 12 to pull the piston rod 12 down. Bores 14' extend through the wall of the piston rod guide 14 to enable oil to pass within the piston rod guide and around the piston rod 12. The bottom piston 15 is all of the inner diameter of the lower cylinder block 2 and has a longer cross-sectional area than the top piston 7. The bottom piston 15 is driven down by oil pressure as a result of the explosion of gases on the top piston 7. The downward movement of the piston 15 thereby drives the connecting rod 16 with a high force. However it is noted that the bottom piston 15 cannot reach a BDC stroke distance.

Because the explosion pressure is transfered to the bottom piston 15 in proportion to the cross-sectional area between the top piston 7 and the bottom piston 15. Thus the stroke distance of the bottom piston 15 is shorter than the BDC stroke distance and the explosion pressure is reduced to zero before the top piston 7 reaches the BDC stroke distance. As to this, this invention is provided with an annular ring type piston 17 within external chamber 9 communicated through a compresed air guide pipe 18 which extends through the cylinder head. As soon as the pressure within the cylinder chamber drops below air tank pressure (10 kg/cm$^2$), the guide pipe 18 conveys the compressed air from an external compressed air tank 27 to the annular ring type piston to push the annular ring type piston down so that the oil within the external chamber 9 is forced down with greater pressure to push the bottom piston 15 to the BDC stroke distance.

While the above described embodiment of the present invention uses the guide pipe 18, instead of the annular ring type piston 17, high pressure oil may be injected and exhausted with booster for oil pressure directly.

In another embodiment use it is not made of the annular ring type piston 17 or air pressure and booster for oil pressure. The length of the internal chamber is about $\frac{1}{3}$ longer than in the first embodiment therefore it is possible to increase the storage amount of oil for oil pressure.

Unexplained terms in the drawings are inlets for supplement of oil for oil pressure 19, inlet for intake of water in a water jacket 20, intake valve 21 and combustion chamber 22. The operation of the first embodiment is as follows.

The crank shaft is revolved by the rotation of the driving motor so that the engine drives and the bottom piston 15 connected with the connecting rod 16 moves down.

The piston rod guide 14 fixed on the bottom piston 15 goes down and draws the piston rod 12 down and simultaneously the top piston 7 goes down.

The downward movement of the top piston 7 results in the lower cylinder block 2 becoming $\frac{2}{3}$ full of oil from within internal chamber 8. External pressure makes the annular ring type piston 17 move down, and then the remaining space of bottom cylinder 2 becomes full.

Therefore, the suction stroke is achieved by the downward movement of the bottom piston 15 and the mixed gas of air and fuel is sucked in.

The compression stroke then begins and the bottom piston 15 moves up the oil which has reached the lower cylinder block 2.

At this time, the oil branches off radical angle 7' of the vertical wall and into the internal cylinder 8 and external chamber 9 respectively and the top piston 7 and side piston 17 are moved up by upward pressure of the oil.

Simultaneously top piston 7 compresses the mixed gas of fuel and air within combustion chamber 22.

At the end of the compression stroke (FIG. 2: TDC 0), a spark plug is ignited and the mixture combusted. Simultaneously a high pressure gas explosion pushes down the top piston 7 with cross-sectional area 64 Cm$^2$×45 Kg/Cm$^2$ of the top piston. At this time, when the oil for oil pressure within internal chamber 8 is at crank angle TDC 15 (refer to FIG. 2) maximum explosion pressure (45–55 Kg/Cm$^2$) acts therefore the oil presses directly on the bottom piston 15 with cross-sectional area 129 Cm$^2$×45 Kg/Cm$^2$ of the bottom piston.

As soon as the top piston 7 is moved downward by explosion gas pressure as shown in FIG. 2 and the gas pressure becomes a maximum, the pressure drops down rapidly and becomes a maximum, the pressure drops down rapidly and becomes atmospheric pressure at TDC 100. The ring type piston 17 operates to move the bottom piston beyond BDC because of this phenomenon the top piston 7 and the bottom piston 15 show the same pressure drop curve diagram.

The cross-sectional area of the bottom piston 15 is large and great oil pressure acts on it. Therefore the connecting rod 16 which is connected with the bottom piston makes the crankshaft revolve with great force causing great force to stored in a heavy flywheel by inertia for repeated exhaust, suction, compression and explosion strokes.

Accordingly, it is a characteristic of the present embodiments to provide a great rotation force and speed with a small combustion chamber volume, therefore decreasing fuel loss.

Figure 6:
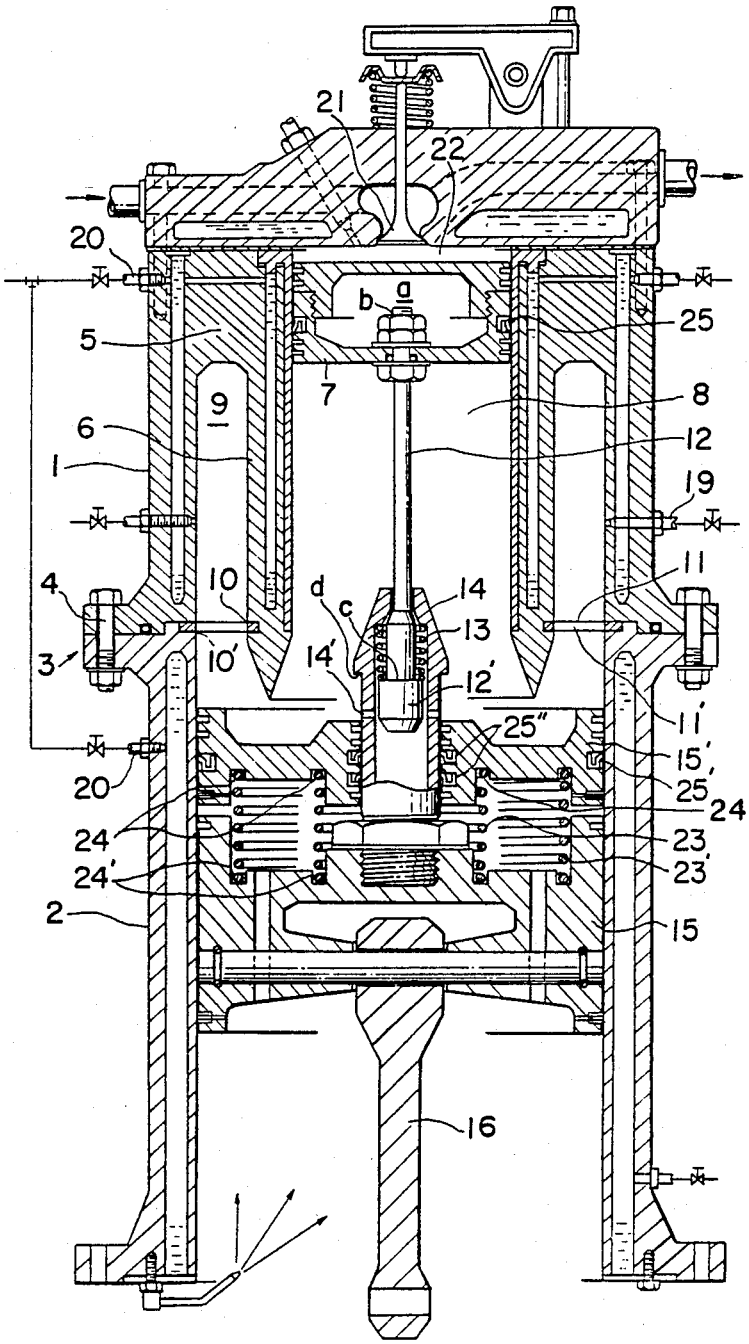
FIG. 6 is a vertical sectional view in accordance with another embodiment of the invention.

FIG. 6 is a vertical sectional view of a main power apparatus in accordance with a second embodiment of the present invention.

Figure 3:
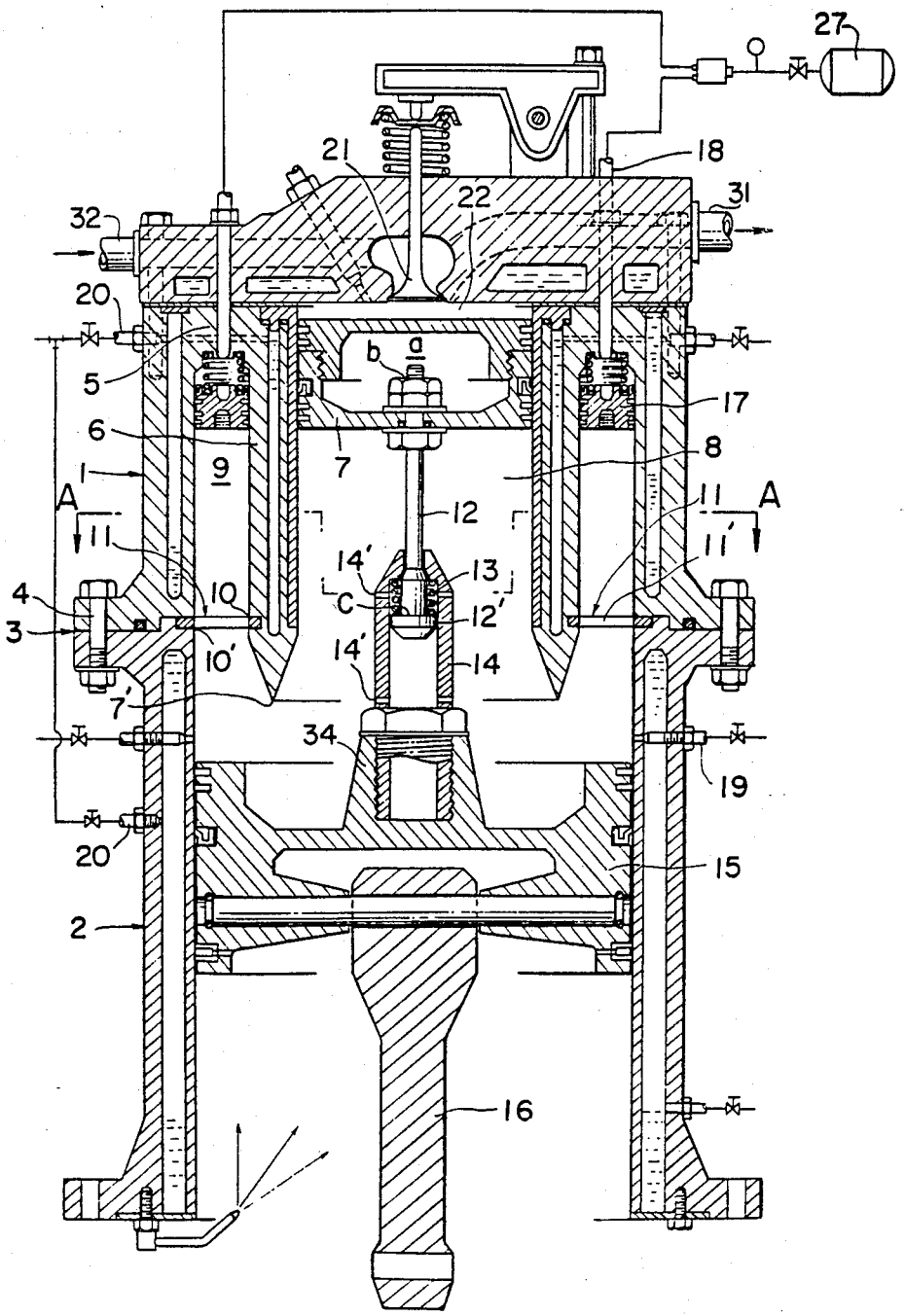
FIG. 3 is a vertical sectional view of one embodiment of piston power transmission apparatus in accordance with the present invention.
Figure 4:
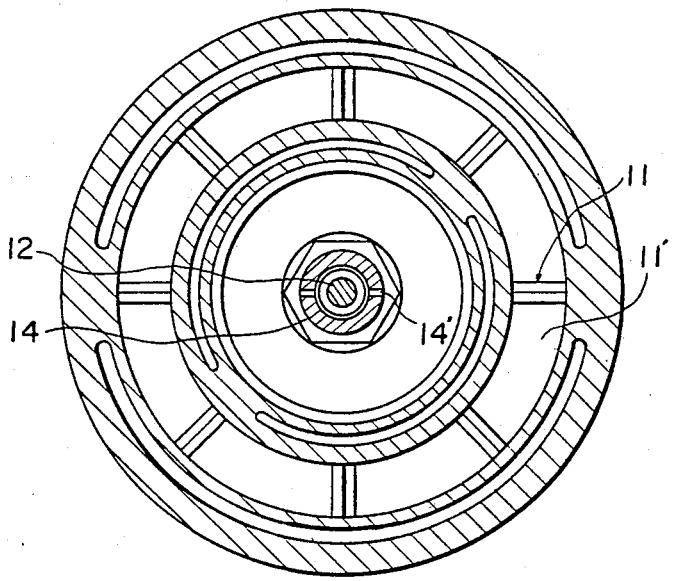
FIG. 4 is a cross sectional view on line A—A of FIG. 3
Figure 5:
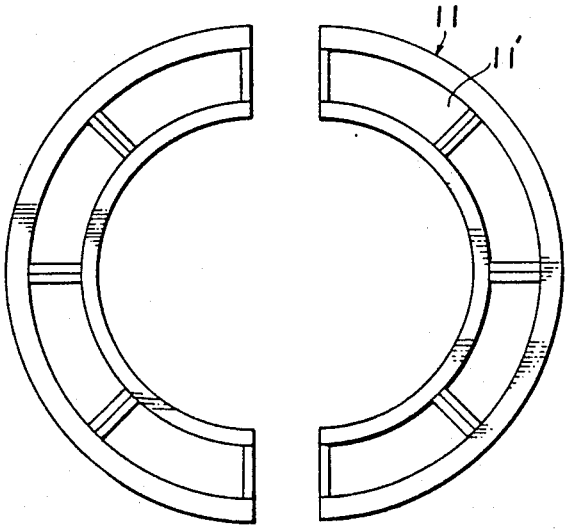
FIG. 5 is a structural drawing of a support ring to support the cylinder block of a top piston.

In FIG. 6 the same reference numbers are used for the same or similar parts as shown in FIG. 3 to FIG. 5.

In the second embodiment, the length of the external cylinder 9 in the top cylinder 1 is shorter than in FIG. 3 and the annular ring type piston 17 shown in FIG. 3 is omitted together with the guide pipe 18 for sucking compression air or high pressure oil from outer.

Because of this, the bottom cylinder 2 is filled $\frac{2}{3}$ full only with oil from within the internal chamber 8 and external chamber 9, the remaining $\frac{1}{3}$ to be found as following. The bottom piston 15 and a middle piston 15' have the same diameter but the middle piston 15' is slidable on the piston rod guide 14 outer diameter. A double coil spring 23, 23' is located within opposite spring seats 24, 24' between both pistons 15, 15' so that the interval between both pistons 15, 15' is maintained. Oil seats 25, 25', 25'' prevent oil leakage from outside.

The engine drives and the gas pressure explosion within combustion chamber 22 pushes the top piston 7 so that oil within the inside cylinder pushes the middle piston 15' instantaneously, therefore the middle piston 15' and the bottom piston 15 move down with the assembly. The middle piston 15' reaches TDC 35 and then gas pressure within the combustion chamber 22 drops rapidly and from this time the middle piston is moved down by inertia. Due to the tension of the double coil spring acting on the middle piston 15' and the bottom piston 15 move down with gap gradually, and the gap between middle piston 15' and the bottom piston 15 becomes a maximum. At this time the top side of the middle piston 15' contacts and (d) of the piston rod guide 14 and the bottom piston 15 reaches BDC.

Accordingly, oil within internal chamber 8 moves within the bottom cylinder block 2 and fills $\frac{2}{3}$ of the bottom cylinder block 2, the remaining $\frac{1}{3}$ is recruited by the middle piston 15' bolstered with the double coil spring 23, 23'.

Therefore, as to be shown the first embodiment does not suck compression air and oil from outside directly, satisfying unsufficient oil inside.

The compression stroke starts again and then the piston 15 starts to move up. The double coil spring 23, 23' pushes the middle piston 15' and this middle piston 15' pushes oil and therefore the top piston 7 is moved up by oil. At this time the intake and exhaust valves are closed and suction fuel and mixed gas is compressed, therefore pressure loads act on top piston 7 which are transferred to the middle piston 15' and the upward force of the bottom piston 15 compresses the double coil spring 23, 23' so that the distance between the middle piston 15' is gradually decreased and then they almost contact each other, moving up and the middle piston 15' reaches at TDC.

At this time the explosion stroke begins again at the end of compression stroke and the movement repeats itself.

The above described embodiment, may be used for example for land and marine two stroke engines and aircraft engines.

An example of the dimensions of apparatus embodying the present invention is as follows:

| (a) Design data (4 stroke gasoline engine): | |
|---|---|
| (1) top piston diameter: | 54 mm |
| (2) bottom piston diameter: | 67 mm |
| (3) stroke: | 50 mm |
| (4) RPM: | 3600 rpm (maximum)<br>2500 rpm |
| (5) engine driving motor: | 1 Hp |
| (6) fuel: | gasoline |
| (7) a one cylindered engine | |
| **(b) Model specification of an experimental convention engine:** | |
| (1) piston diameter: | 54 mm |
| (2) piston stroke: | 40 mm |
| (3) the number of crank rotations: | 3600 rpm (max) |
| (4) the number of pistons engine: | a one cylindered |
| (5) 4 stroke gasoline engine: | |
| (6) the horse power of an engine: | 1.7 Hp |
| (7) flywheel weight: | 3.4 Kg |

-continued

| (c) Experimental data: | |
|---|---|
| (1) horse power: | 2.72~2.78 Hp (increasing about 60%) |
| (2) RPM: | 3,600 (max) |
| (3) flywheel weight: | 17 Kg |

(Although flywheel weight is increasing, crank rotation force is not variable to be proved by experimental results.)

I claim:

1. A piston power transmission apparatus for an internal combustion engine comprising a piston power transmission apparatus with an upper cylinder block and a lower cylinder block connected together at flange means thereof and having equal internal diameters, a cylindrical vertical wall extending within and from an upper portion of the upper cylinder block to divide the upper cylinder block into an internal chamber and external chamber, a top piston being housed in the internal chamber in which a combustion chamber is formed above the top piston to move up and down inside the vertical wall, an angular ring type piston being mounted in the external chamber communicated through a guide pipe with an outer compressed air tank which employs means for causing the annular ring type piston to move downward toward the lower cylinder block as soon as pressure in the internal and external chamber falls below that within the compressed air tank, a bottom piston being slidably mounted in the lower cylinder block with a larger cross-sectional area than that of the top piston, a piston rod being arranged between the top piston and a piston rod guide in such a manner that its upper end is fixed to the top piston and its lower end is inserted through a top end of the piston rod guide into an inside thereof, and is retained therein via an enlarged head on the piston rod having an outer diameter substantially equal to that of the inside of the piston rod guide and which is spring biased towards the top end of the piston rod guide wherein relative movement between the piston rod and the piston rod guide is controlled by flow of fluid through bores located on opposite ends of and through the piston rod guide in contact with respective opposite sides of the piston rod enlarged head, the piston rod guide being connected to the bottom piston by engaging a threaded portion of its lower end with a threaded portion of a bottom piston projection, a connecting rod being connected to the bottom piston by a piston pin inserted into the base of said bottom piston, a resulting space enclosed by the top piston, the annular ring type piston and the bottom piston being freely communicating and filled with an incompressible fluid oil.

2. A piston power transmission apparatus for an internal combustion engine as claimed in claim 1 comprising means for transferring high pressure oil from outside the cylinder blocks to inside said blocks.

* * * * *